US005078449A

United States Patent [19]

Suzuki

[11] Patent Number: 5,078,449

[45] Date of Patent: Jan. 7, 1992

[54] LUMBAR SUPPORT DEVICE

[75] Inventor: Mamoru Suzuki, Yokohama, Japan

[73] Assignee: Ikeda Bussan Co., Ltd., Japan

[21] Appl. No.: 669,915

[22] Filed: Mar. 15, 1991

[30] Foreign Application Priority Data

Mar. 20, 1990 [JP] Japan ..... 2-28939[U]

[51] Int. Cl.[5] ..... A47C 3/00

[52] U.S. Cl. ..... 297/284 C; 297/353

[58] Field of Search ..... 297/284, 353

[56] References Cited

U.S. PATENT DOCUMENTS

| | | | |
|---|---|---|---|
| 4,636,000 | 1/1987 | Nishino | 297/284 |
| 4,714,291 | 12/1987 | Hattori et al. | 297/284 |
| 4,811,986 | 3/1989 | Hattori et al. | 297/284 |
| 4,981,321 | 1/1991 | Zacharkow | 297/284 |
| 5,011,223 | 4/1991 | Kato | 297/284 |

FOREIGN PATENT DOCUMENTS

| | | | |
|---|---|---|---|
| 939909 | 10/1963 | United Kingdom | 297/284 |

*Primary Examiner*—Laurie K. Cranmer

*Attorney, Agent, or Firm*—Gifford, Groh, Sprinkle, Patmore and Anderson

[57] ABSTRACT

An adjustable lumbar support device for a seat having a lumbar support panel arranged in the backrest of the seat. The lumbar support panel is movable in a forward direction and rearward direction by a spring member. The spring member has a base end portion in contact with the back of the lumbar support panel and terminal ends pivotably connected to a bracket mounted in the backrest of the seat. A threaded shaft axially displaces a holding bracket near the terminal ends of the spring member when the threaded shaft is rotated either manually or by an electric motor. The rotation of the threaded shaft axially displaces the holding bracket which pivots the spring member to move the lumbar support panel forwardly or rearwardly.

6 Claims, 2 Drawing Sheets

LUMBAR SUPPORT DEVICE

BACKGROUND OF THE INVENTION

I. Field of the Invention:

The present invention relates to an improvement in a lumbar support device which is arranged in the seatback to support a lumbar portion of an occupant of the seat. The lumbar support device provides the seat occupant with a comfortable feeling while sitting.

II. Description of the Prior Art

It has been desired that a seat occupant is stably held during operation of the motor vehicle. It is also desirable that the seat occupant feel comfortable while sitting. Ideally, the seat is designed to prevent the occupant from suffering a marked fatigue even after a lengthy period of sitting. In order to obtain these desired merits, the seat is equipped at various places with support devices.

These support devices are, for example, a side support device which is arranged to support the side of the occupant and a lumbar support device which supports a lumbar portion of the occupant; these support devices are known.

In the lumbar support device, a pad member having a suitable hardness is movably disposed in the seatback at a position which faces the lumbar portion of the occupant. By moving the pad member forward or rearward, a lower portion of the seatback is swelled out at need.

Various lumbar support devices are known. For example, Japanese Utility Model First Provisional Publication 51-163224 and Japanese Patent First Provisional Publication 57-19965 disclose a cushion member in the back of the seat which is adjustable for hardness by combining a spring member located behind the cushion member and a threaded shaft adjusting means. In this lumbar support device, the hardness of the cushion member can be steplessly adjusted by the threaded shaft adjusting means, so that fine control is easily achieved. In addition, excellent impact resistance and marked adjusting stroke are obtained.

However, the above-mentioned lumbar support device has the following drawbacks. That is, when the spring member is assembled, one end portion of the spring member is in contact with the back side surface of the cushion member. Therefore, a troublesome and complicated assembly procedure is necessary. A middle portion of the spring member must be formed to have a coiled portion and the coiled portion is pivotally fitted to a pin which is fixed to a bracket in the seatback. In addition, numerous parts and steps are needed for the assembly of the device which cause an increase in production cost.

Furthermore, in the above-mentioned lumbar support device, the arrangement to pivotally connect the middle portion of the spring member to the pin and the other arrangement to connect the other end of the spring member to the threaded shaft adjusting means limit the usable space. The entire construction of the device tends to have a large size, so that design freedom is limited. Thus, solving these drawbacks has been hitherto desired.

Additionally, in the lumbar support devices taught by the prior art, the spring member whose coiled portion is pivotally connected to the pin of the seatback is swingably moved by the operation of the threaded shaft adjusting means. The other end portion of the spring member is moved by the operation of the threaded shaft adjusting means so that the other end portion of the spring member adjusts the degree of movement of the cushion member.

Thus, the resilient force of the spring member is kept constant, so that for achieving an effective lumbar supporting function, it becomes necessary to enlarge the stroke by a certain degree. Considering this, a control knob which must be turned many times for driving the threaded shaft adjusting means is not suitable. In addition, drivability of the control knob is poor.

SUMMARY OF THE PRESENT INVENTION

In order to solve these problems, the present invention provides a lumbar support device in which a panel serving as a lumbar support is arranged within the backrest of the vehicle's seat. The lumbar support device is located at a side near the occupant supporting surface of the backrest in a manner to allow movement forward and rearward by a spring member.

The spring member has a base end portion which is in contact with a back side of the panel and terminal ends which are pivotally connected to a bracket which is mounted within the backrest. A threaded shaft adjusting mechanism is arranged in the backrest which includes a nut member which slidably holds a portion near the terminal ends of the spring member, and a threaded shaft which moves the nut member forward and rearward.

According to the present invention, the base end portion of the spring member is located at the back face side of the panel, and the terminal end portions of the spring member are rotatably connected to the bracket of the backrest. The threaded shaft adjusting means is arranged near the position where the terminal end portions of the spring member are rotatably connected to the bracket of the seat's backrest. The adjusting means has a nut member which slidably holds the terminal end portions of the spring member. When the threaded shaft is rotated the nut member urges the spring member toward and away from the occupant.

The lumbar support device of the present invention has an arrangement in which a panel serving as a lumbar support is located within a backrest of a seat at a side near the occupant supporting surface of the backrest. The lumbar support device is movable forwardly and rearwardly. A spring member is used which has a base end portion in contact with a back side of the panel and terminal ends pivotally connected to a bracket which is mounted within the backrest. A threaded shaft adjusting mechanism includes a holding bracket which slidably holds a portion of the spring member near the terminal ends, and a threaded shaft which is arranged to axially displace the holding bracket forward and rearward.

Thus, although the arrangement of this lumbar support device is simple in construction and economical as is described hereinabove, the spring member can be assembled with ease by directly fitting the terminal end portions of the spring member to the bracket which serves as a bearing means. In addition, the number of parts needed for the assembly can be reduced and thus the device of the invention can be constructed with simple work and reduced cost.

In the invention, the adjacent portion of the terminating end portions of the spring member near the shaft bearing portion is pressed outwardly by the nut member of the threaded shaft adjusting mechanism. It is possible to move the panel forward and backward by displacing the spring member toward the occupant's sitting surface. Thus, as compared with the prior art device, the present invention is compact and allows better placement of the various parts.

Furthermore, it is possible to achieve a large operating stroke by a small movement of the nut member, and due to the movement of the holding position induced by the stroke, the spring force applied to the panel can be changed. An effective lumbar support device is therefore achieved by the invention.

BRIEF DESCRIPTION OF THE DRAWINGS

The present invention will be more fully understood by reference to the following detailed description of the preferred embodiments of the present invention when read in conjunction with the accompanying drawings.

DETAILED DESCRIPTION OF THE PREFERRED EMBODIMENT OF THE PRESENT INVENTION

Figure 1:
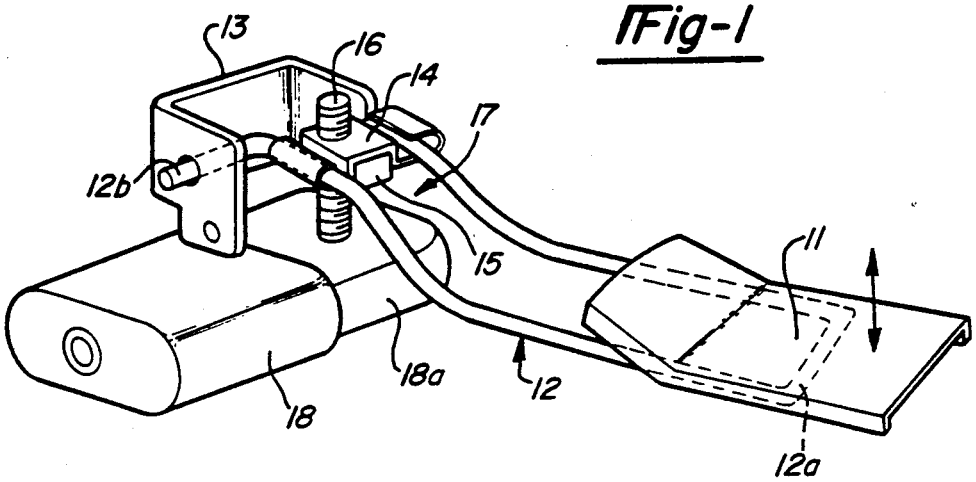
FIG. 1 is a schematically illustrated perspective view of an essential portion of a lumbar support device which is an embodiment of the present invention.
Figure 2:
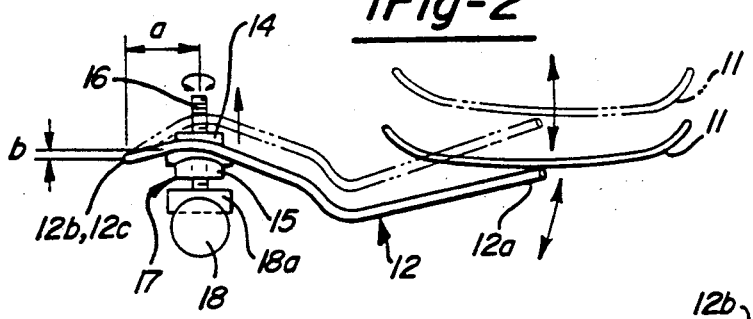
FIG. 2 is a schematic view for explaining the operation of the lumbar support device.
Figure 3:
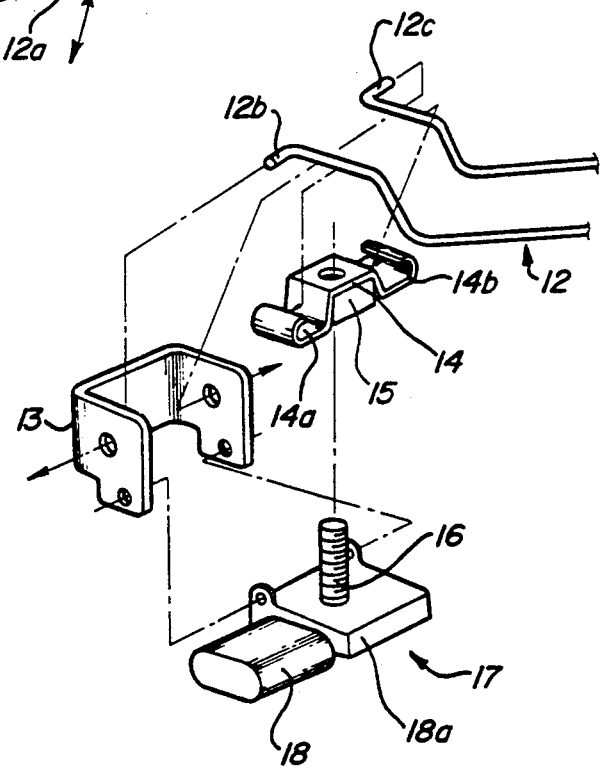
FIG. 3 is an exploded and perspective view of the essential portion lumbar support device.
Figure 4:
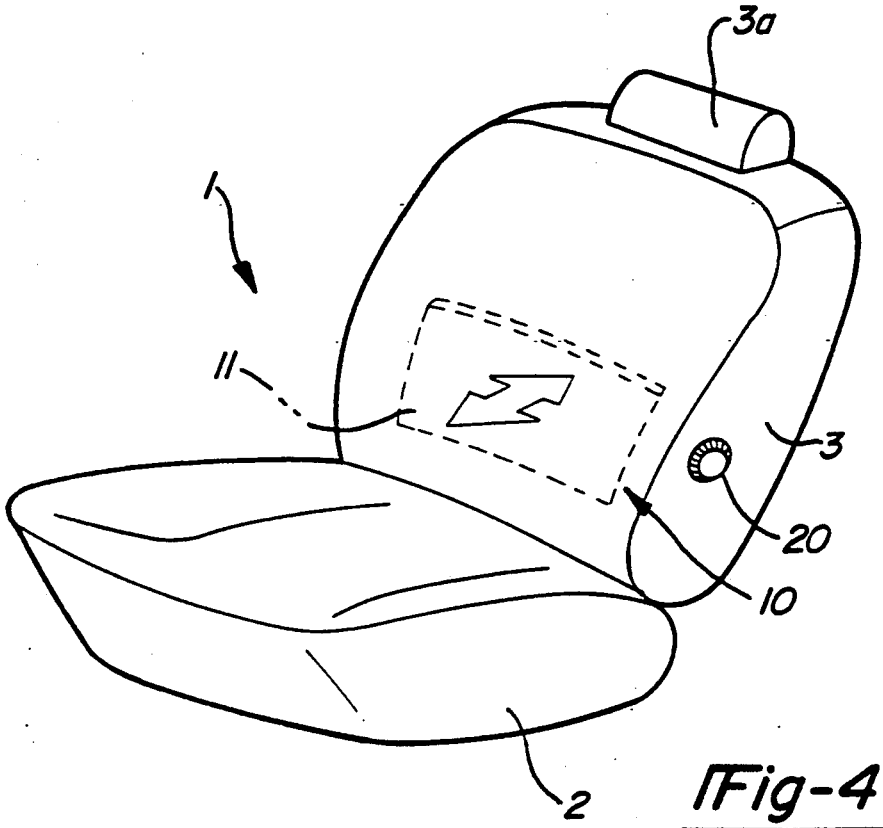
FIG. 4 a schematically illustrated perspective view of a vehicular seat to which the present invention is applied.

In the drawings, FIG. 4 shows a vehicular seat. The seat 1 comprises a seat cushion 2 and a backrest 3 which is arranged on a rear end of the seat cushion and has a head rest 3*a* mounted thereon. A lumbar support device 10 is disposed in a center lower portion of the backrest 3 and has the following construction.

As is seen from FIGS. 1 to 4, the lumbar support device 10 which characterizes the present invention comprises a panel 11 which is arranged in the backrest 3 in a manner to move toward and away from an occupant sitting on seat cushion 2 to serve as a lumbar support. A generally U-shaped spring member 12, constructed of a spring wire, has a base end portion 12*a* contacting a back face of the panel 11 and terminal end portions 12*b* and 12*c*.

The terminal end portions 12*b* and 12*c* are rotatably connected to a bracket 13 mounted in the backrest back 3. A threaded shaft adjusting mechanism 17 includes a nut member 15 which is attached to a holding bracket 14. The holding bracket 14 slidably holds portions of the spring member 12 near the terminal end portions 12*b* and 12*c*. A threaded shaft 16 moves the nut member 15 toward and away from the occupant sitting in the seat 1.

In the above-mentioned construction, the distance "a" or "b" between a shaft bearing portion defined by the terminal end portion 12*b* or 12*c* of the spring member 12 and an axis 16 of a threaded shaft or the center of the nut member 15 has a certain freedom. Thus, as compared with the prior art lumbar support devices, where a center portion of a spring member is held in a bearing, the above-described construction has considerable freedom in selecting the position where the nut member 15 and the location of the terminal ends of the spring member 12 are located. For this reason, various parts of the device can be made compact resulting in considerable space savings. These merits are obtained by locating the nut member 15 near the shaft bearing portion (terminal end portions 12*b* and 12*c*) of the spring member 12 as close as possible.

Holding portions 14*a* and 14*b* are formed at opposite end portions of the holding bracket 14 which is attached or are an integral part of the nut member 15. The holding portions 14*a* and 14*b* are arranged to hold the spring member 12 near its terminal end portions 12*b* and 12*c*. The holding portions 14*a* and 14*b* also permit axially sliding movement of the spring member 12 therein.

An electric motor 18 and a gear box 18*a* are used for rotating the threaded shaft 16 to longitudinally displace the holding bracket 14. The bracket 13 is pivotally supported on the gear box 18*a* of the motor 18 and the gear box 18*a* is fixedly mounted to the frame of the backrest 3.

Figure 5:
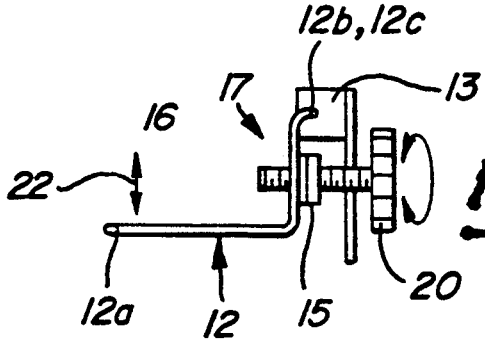
FIG. 5 is a schematic view showing another embodiment of the present invention.

The present invention, however, is not limited to such arrangement shown in FIGS. 1–4. For example, as is shown in FIG. 5, a structure may be employed in which the above-mentioned threaded shaft 16 is rotated by a manually rotatable knob 20 which is mounted on a side portion of the backrest 3. By manually rotating the knob 20, the nut member 15 is axially displaced along threaded shaft 16 which pivotably displaces the spring member 12 forwards and backwards as indicated by double headed arrow 22.

In the arrangement shown in FIG. 5, the base end portion 12*a* of the spring member 12 engages the back face side of the panel 11. The terminal end portions 12*b* and 12*c* are bent perpendicularly with respect to the longitudinal direction of the spring member 12 and are pivotably connected to the bracket 13. The nut member 15 of the threaded shaft adjusting mechanism 17 is mounted at a location near the position where the terminal end portions 12*b* and 12*c* of the spring member 12 are pivotably connected to the bracket 13. The nut member 15 as discussed relative to the arrangement of FIGS. 1–4 slidably supports the the spring member 12 near the terminal end portions 12*b* and 12*c*. The displacement of the nut member 15 along threaded shaft 16 produced by the rotation of the threaded shaft 16 pivots the spring member 12 so that its base end portion 12*a* is moved toward and away from the occupant sitting on the seat cushion 2.

As is evident to those skilled in the art, the structure of this lumbar support device is simple and may be manufactured economically. The spring member 12 can be assembled with ease by directly fitting the terminal end portions 12*b* and 12*c* of the spring member 12 to the bracket 13 which serves as a pivot support. In addition, the number of parts needed for the assembly can be reduced and thus the device of the invention can be simply constructed with reduced cost.

In the invention, the adjacent portion of the terminating end portions 12*b* and 12*c* of the spring member 12 near the shaft bearing portion are displaced by the holder bracket 14 of the threaded shaft adjusting mechanism 17. Thus, it is possible to move the panel 11 forward and backward by pivoting the spring member 12 toward or away from the occupant sitting on the seat cushion 2.

As compared with the conventional device, the present invention is compact and provides an efficient layout of the various parts. Furthermore, it is possible to achieve a large displacement by a small movement of the nut member, and due to the displacement of the holding bracket 14 induced by the displacement of nut member 15, the spring force applied to the panel 11 can thus be changed to achieve the effective function of the lumbar support device.

It is to be noted that the present invention is not limited to the embodiment described hereinabove. Many modifications will be come apparent to those skilled in the art to which it pertains without deviation from the spirit of the invention as defined by the scope of the appended claims. Usage of the lumbar support device of the invention is not limited to the above-mentioned vehicular seat 1. That is, the lumbar support device of the invention is applicable to various types of seats.

I claim:

1. An adjustable lumbar support device for a backrest of a seat comprising:

a movable lumbar support panel having a front side and a back side arranged within said backrest;

a spring member having a base end and terminal ends;

said base end of said spring member being attached to said back side of said movable lumbar support panel;

a bracket fixedly disposed within said backrest;

said terminal ends of said spring member being pivotably connected to said bracket;

a holding bracket slidingly holding said spring member near said terminal ends;

said holding bracket having a nut member attached thereto and a threaded shaft threadably engaging said nut member; and means for rotating said threaded shaft to axially displace said holding bracket along said threaded shaft, said axial displacement of said holding bracket pivotably displacing said spring member and said pivotable displacement of said spring member displacing said lumbar support panel.

2. The adjustable lumbar support device of claim 1 wherein said means for rotating said threaded shaft is an electric motor.

3. The adjustable lumbar support device of claim 2 having a gear box intermediate said electric motor and said threaded shaft.

4. The adjustable lumbar support device of claim 3 wherein said bracket is pivotally attached to said gear box.

5. The adjustable lumbar support device of claim 3 wherein said backrest has a side portion and said knob is mounted on said side portion of said backrest.

6. The adjustable lumbar support device of claim 1 wherein said means for rotating said threaded shaft is a knob.

* * * * *